US008205537B1

(12) United States Patent
Dupont

(10) Patent No.: US 8,205,537 B1
(45) Date of Patent: Jun. 26, 2012

(54) INTERCEPTOR PROJECTILE WITH NET AND TETHER

(75) Inventor: James H. Dupont, Bowie, AZ (US)

(73) Assignee: Raytheon Company, Waltham, MA (US)

( * ) Notice: Subject to any disclaimer, the term of this patent is extended or adjusted under 35 U.S.C. 154(b) by 989 days.

(21) Appl. No.: 12/189,299

(22) Filed: Aug. 11, 2008

(51) Int. Cl.
*F42B 12/68* (2006.01)

(52) U.S. Cl. ..... 89/1.34; 102/504

(58) Field of Classification Search ..... 114/382; 342/62

See application file for complete search history.

(56) References Cited

U.S. PATENT DOCUMENTS

| | | | | | |
|---|---|---|---|---|---|
| 1,211,001 | A | | 1/1917 | Steinmetz | |
| 1,247,331 | A | | 11/1917 | Robinson | |
| 1,274,419 | A | | 8/1918 | Jackson | |
| 1,536,164 | A | | 5/1925 | Tainton | |
| 2,296,980 | A | * | 9/1942 | Carmichael | 102/504 |
| 2,308,683 | A | | 1/1943 | Forbes | |
| 2,322,624 | A | | 6/1943 | Forbes | |
| 3,710,720 | A | * | 1/1973 | Mawhinney | 102/391 |
| 3,803,463 | A | * | 4/1974 | Cover | 361/232 |
| 3,804,019 | A | * | 4/1974 | Hurley | 102/448 |
| 4,090,567 | A | * | 5/1978 | Tomlinson | 169/53 |
| 4,142,696 | A | * | 3/1979 | Nottingham | 244/3.16 |
| 4,193,567 | A | * | 3/1980 | McCarty, Jr. | 244/3.16 |
| 4,231,311 | A | * | 11/1980 | Longerich | 114/244 |
| 4,253,132 | A | * | 2/1981 | Cover | 361/232 |
| 4,833,995 | A | * | 5/1989 | Gotz et al. | 102/521 |
| 5,069,109 | A | * | 12/1991 | Lavan, Jr. | 89/1.11 |
| 5,280,843 | A | * | 1/1994 | Vartija et al. | 473/576 |
| 5,495,787 | A | * | 3/1996 | Boyer, III | 89/1.11 |
| 5,583,311 | A | * | 12/1996 | Rieger | 89/1.11 |
| 5,750,918 | A | * | 5/1998 | Mangolds et al. | 102/502 |
| 5,898,125 | A | * | 4/1999 | Mangolds et al. | 102/439 |
| 5,988,036 | A | * | 11/1999 | Mangolds et al. | 86/1.1 |
| 6,079,398 | A | * | 6/2000 | Grimm | 124/16 |
| 6,220,918 | B1 | * | 4/2001 | Laronge | 446/63 |

(Continued)

FOREIGN PATENT DOCUMENTS

JP 2002355323 A * 12/2002

OTHER PUBLICATIONS

"Force Protection Systems", Pacific Scientific Energetic Materials Company, [retrieved online], <http://www.psemc.com/force_protection.htm>.

(Continued)

*Primary Examiner* — Michael Carone
*Assistant Examiner* — Joshua Freeman
(74) *Attorney, Agent, or Firm* — Renner, Otto, Boisselle & Sklar, LLP

(57) ABSTRACT

An interceptor projectile includes a deployable net that deploys during flight and wraps around an incoming projectile, such as a rocket propelled grenade (RPG). The net is initially in a tubular body of the interceptor projectile. A propellant is used to deploy the net from the body. Even after deployment the net remains attached to the body by an elastic tether. The engagement of the net with the incoming projectile disables the incoming projectile, with the momentum imparted by the interceptor projectile sending the incoming projectile off course. This successfully defends a target against the incoming projectile. Through the tether, substantially all of the parts of the interceptor projectile may be mechanically linked together even after deployment of the net. This mechanical linking provides more momentum for impacting the interceptor projectile, which may facilitate diverting the incoming projectile.

19 Claims, 6 Drawing Sheets

U.S. PATENT DOCUMENTS

| | | | | |
|---|---|---|---|---|
| 6,325,015 | B1 * | 12/2001 | Garcia et al. | 114/382 |
| 6,382,105 | B1 * | 5/2002 | Jones | 102/370 |
| 6,454,623 | B1 * | 9/2002 | Flatau | 446/34 |
| 6,626,077 | B1 * | 9/2003 | Gilbert | 89/1.11 |
| 6,854,374 | B1 * | 2/2005 | Breazeale | 86/50 |
| 6,904,838 | B1 * | 6/2005 | Dindl | 89/1.1 |
| 6,957,602 | B1 * | 10/2005 | Koenig et al. | 89/1.11 |
| 6,959,893 | B1 * | 11/2005 | Sadowski et al. | 244/3.16 |
| 7,190,304 | B1 | 3/2007 | Carlson | |
| 7,202,809 | B1 | 4/2007 | Schade et al. | |
| 7,328,644 | B2 * | 2/2008 | Vickroy | 89/1.11 |
| 7,398,617 | B2 * | 7/2008 | Mattox | 43/58 |
| 7,412,916 | B2 * | 8/2008 | Lloyd | 89/1.11 |
| 7,415,917 | B2 * | 8/2008 | Lloyd | 102/473 |
| 7,441,511 | B2 * | 10/2008 | Farinella et al. | 114/382 |
| 8,122,810 | B2 * | 2/2012 | Glasson | 89/1.11 |
| 2005/0016372 | A1 * | 1/2005 | Kilvert | 89/1.34 |
| 2005/0132923 | A1 * | 6/2005 | Lloyd | 102/477 |
| 2005/0183615 | A1 * | 8/2005 | Flatau | 102/503 |
| 2005/0192581 | A1 * | 9/2005 | Molz et al. | 606/74 |
| 2006/0112817 | A1 * | 6/2006 | Lloyd | 89/1.11 |
| 2006/0169832 | A1 * | 8/2006 | Glasson | 244/3.1 |
| 2006/0225598 | A1 * | 10/2006 | Okamoto et al. | 102/218 |
| 2007/0079819 | A1 * | 4/2007 | Vanek et al. | 124/16 |
| 2007/0180983 | A1 * | 8/2007 | Farinella et al. | 89/36.07 |
| 2007/0261542 | A1 * | 11/2007 | Chang et al. | 89/1.11 |
| 2008/0129166 | A1 * | 6/2008 | Benneche et al. | 312/292 |
| 2009/0114761 | A1 * | 5/2009 | Sells, II | 244/3.1 |
| 2009/0266226 | A1 * | 10/2009 | Beach et al. | 89/36.02 |
| 2010/0132580 | A1 * | 6/2010 | Nazdratenko | 102/502 |
| 2010/0307328 | A1 * | 12/2010 | Hoadley et al. | 89/36.02 |
| 2012/0011996 | A1 * | 1/2012 | Glasson | 89/36.17 |

OTHER PUBLICATIONS

"IABS—RPG Active Countermeasure", IABS RPG Countermeasure, (2002-2006), [retrieved online], <http://www.defence-update.com/products/i/IABS.htm>.

Application of Related U.S. Appl. No. 12/189,294, filed Aug. 11, 2008.

Application of Related U.S. Appl. No. 12/189,302, filed Aug. 11, 2008.

* cited by examiner

INTERCEPTOR PROJECTILE WITH NET AND TETHER

BACKGROUND OF THE INVENTION

1. Technical Field of the Invention

The invention is in the field of devices and methods for defending against incoming projectiles.

2. Description of the Related Art

Rocket propelled grenades (RPGs) are examples of a type of projectile that poses a great threat to ground vehicles, aircraft, and helicopters. RPGs are commonly used during close-in military engagements, where the shooter and the target are close to one another. Defeating an incoming RPG with a fragmentation warhead interceptor may destroy the incoming RPG, but may also in the process produce a shower of fragments. These fragments may injure personnel or cause damage, such as by causing damage to a helicopter that is being fired upon. From the foregoing it will be appreciated that it may be desirable to have improved ways of dealing with incoming projectiles.

SUMMARY OF THE INVENTION

A weapons interceptor projectile includes a deployable net that wraps around and disables an incoming projectile. The net is deployed from a body of the interceptor projectile. Even after deployment the net remains mechanically coupled to the interceptor body through a tether connecting the two. The net ensnares and disables the incoming projectile. The momentum imparted to the incoming projectile causes the incoming projectile to miss its intended target. The tethering of the net to the projectile body increases the momentum of the interceptor projectile that affects the trajectory of the incoming projectile. The interceptor projectile solves the fragmentation problem encountered by projectiles using warheads. In addition, ensnaring an incoming projectile using a net may advantageously allow capture and recovery of an enemy projectile.

In addition, a method of protecting against incoming projectiles may include having multiple interceptor projectiles at different locations. A fire location may be selected as a function of the trajectory of the incoming projectile, so as to provide protection against the incoming projectile.

According to an aspect of the invention, a weapon interceptor projectile includes a deployable net that deploys from an interceptor projectile body. The deployable net remains mechanically coupled to the interceptor projectile body even after deployment of the net.

According to another aspect of the invention, a weapon interceptor projectile has a deployable net that is deployed from a body. A elastic or nonrigid tether keeps the net attached to the tubular body even after the net is deployed.

According to yet another aspect of the invention, a weapon interceptor projectile intercepts and non-explosively disables an incoming projectile.

According to still another aspect of the invention, a weapon interceptor projectile has a deployable net, and impacts an incoming projectile with the net deployed. At the start of the impacting, with the net already deployed, the interceptor projectile impacts the incoming projectile with at least as much momentum as that of the incoming projectile.

According to a further aspect of the invention, an interceptor projectile is fired at an incoming projectile from one of multiple firing locations. The firing location may be selected based on one or more flight characteristics of the incoming projectile, such as trajectory and/or speed. The firing locations may be multiple locations on the same vehicle, such as a ground vehicle or an aircraft such as a helicopter or airplane.

According to another aspect of the invention, a weapon interceptor projectile includes: a body, wherein the body includes a propulsion module that propels the projectile; a net; and a tether attaching the net to the body, even after deployment of the net.

According to yet another aspect of the invention, a method of defending against an incoming projectile includes the steps of: directing an interceptor projectile toward the incoming projectile; deploying a net from the interceptor projectile, while maintaining attachment between the net and an interceptor body of the interceptor projectile, using a tether; and impacting the incoming projectile with the interceptor projectile, thereby deflecting the incoming projectile.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

An interceptor projectile includes a deployable net that deploys upon command during flight (such as by a timer) and wraps around an incoming projectile, such as a rocket propelled grenade (RPG). The net is initially in a body of the interceptor projectile. A propellant is used to deploy the net from the body. Even after deployment the net remains attached to the body by an elastic tether. The engagement of the net with the incoming projectile disables the incoming projectile, with the momentum imparted by the interceptor projectile sending the incoming projectile off course. This successfully defends a target against the incoming projectile. Through the tether, substantially all of the parts of the interceptor projectile may be mechanically linked together even after deployment of the net. This mechanical linking provides additional momentum for impacting the interceptor projectile, which may facilitate diverting the incoming projectile. In addition the mechanical linking may reduce the likelihood of collateral damage to nearby objects, including the target of the incoming projectile.

There may be multiple interceptor projectile launch locations from which interceptor projectiles may be fired. The selection from which launch location to launch or fire an interceptor projectile may be made based on factors involving the flight of the incoming projectile (e.g., trajectory, speed) and/or the relative motion of the incoming projectile and the launch locations (which may be on a vehicle that is the target of the incoming projectile).

Figure 1:
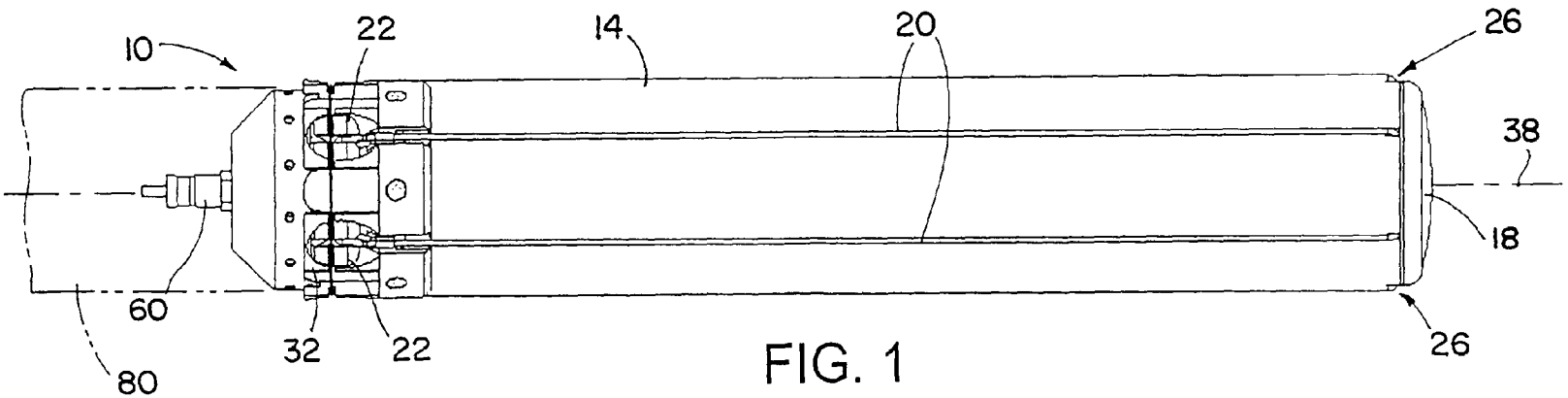
FIG. 1 is a plan view of an interceptor projectile in accordance with an embodiment of the present invention.
Figure 2:
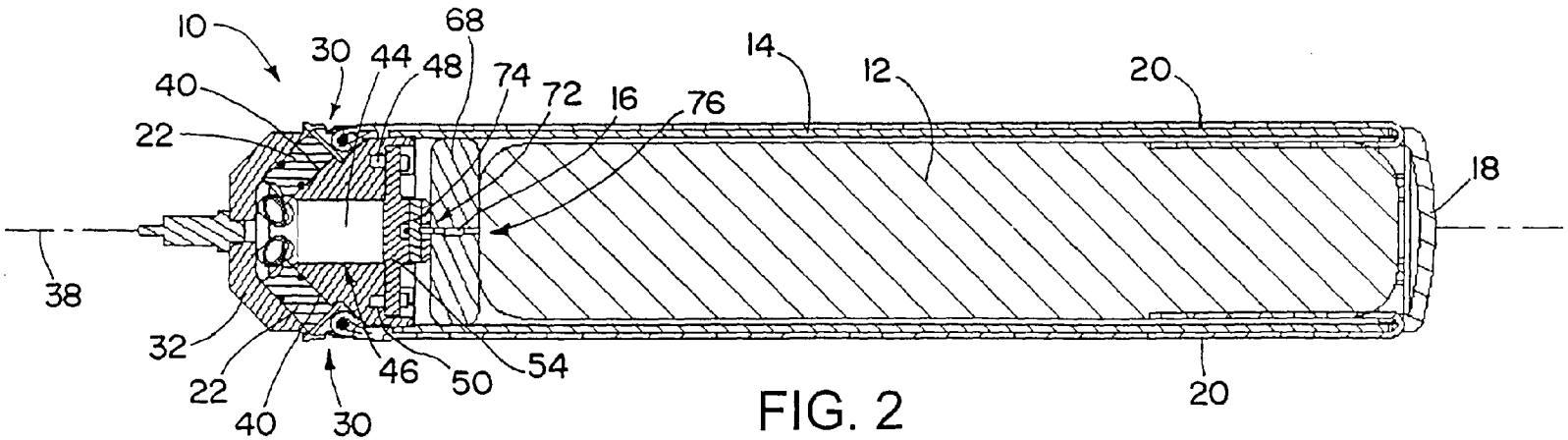
FIG. 2 is a cross-sectional view of the interceptor projectile of FIG. 1.
Figure 3:
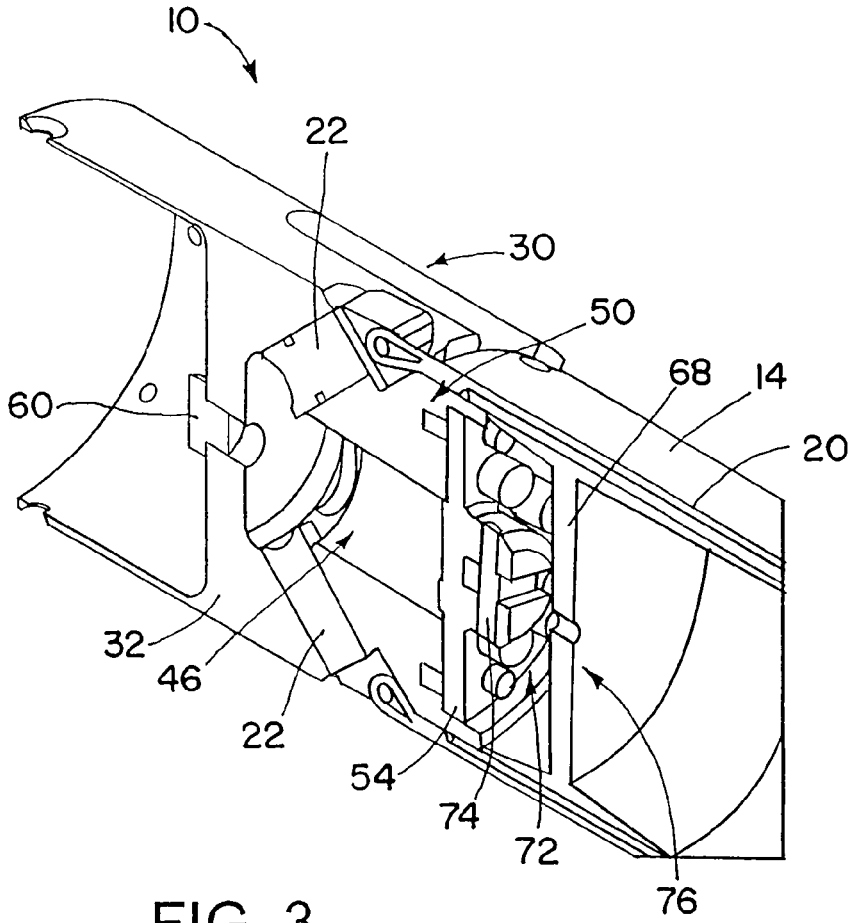
FIG. 3 is a cutaway view of part of the interceptor projectile of FIG. 1.

Referring initially to FIGS. 1-3, an interceptor projectile 10 includes a net 12 that is to be deployed and wrapped around an incoming projectile, such as a rocket propelled grenade (RPG). The net 12 is initially in a tubular body 14, and deploys from the tubular body 14. A tether 16 maintains the attachment between the net 12 and the tubular body 14, even after deployment of the net 12. The net 12 may be a nylon net, or may have netting with another suitable material. As described in greater detail below, the mechanical coupling maintained between the net 12 and the body 14 allows increased momentum transfer upon impact with an incoming projectile. Prior to deployment of the net 12 a cap 18 covers the end of the tubular body 14 from which the net 12 is to be deployed.

Cables or lanyards 20 link the net 12 to a series of weights 22. The cable lanyards may be wire rope-steel cables. The weights 22 may be made of a suitable material, such as cast metal. Steel or other suitable metals may be used. The cable lanyards 20 are attached to the net 12 within the tubular body 14. The cables 20 pass through cable openings 26 in the tubular body 14, adjacent to the nose cap 18, and pass longitudinally aft along the outside of the tubular body 14. The cables 20 are attached to the weights 22, with the weights 22 in angled holes 30 in a base 32 of the interceptor projectile 10. Loops at the ends of the cables 20 go around and are engaged with knobs or rods within the weights 22. The weights 22 may be held in place with tape or a restraining band, prior to being deployed. There are multiple end weights 22, each located in respect of one of the angled holes 30. In the illustrated embodiment there are six of the weights 22 axisymmetrically located about a longitudinal axis 38 of the interceptor projectile 10. It will be appreciated that there may be a greater or lesser number of the weights 22. The weights 22 function to rapidly deploy and expand the net 12 over an area. As explained in greater detail below, the weights 22 also are used in wrapping around and disabling an incoming projectile such as an RPG.

The weights 22 rest on angled surfaces 40 of the base 32. When the weights 22 are deployed from the base 32, the weights 22 head out on a trajectory at an acute angle to the longitudinal axis 38 of the interceptor projectile 10. The angle between the initial direction of travel of the weights 22 and the longitudinal axis 38 may be about 45°, although it will be appreciated that a large range of other angles may be utilized.

Both the net 12 and the weights 22 are deployed using gases from burning propellant charges. The propellant of the interceptor projectile 10 includes a weight propellant charge 44 in a primary propellant chamber 46 of the base 32, and a net propellant charge 48 in a secondary propellant chamber 50. The secondary propellant chamber 50 is between the base 32 and a top plate or vent plate 54 that is attached to the base 32. The propellant charges 44 and 48 are powdered propellant materials. The propellant chambers 46 and 50 are in communication with one another, such that initiation of detonation or combustion in one of the propellant charges 44 and 48 results in detonation or combustion in both of the propellant charges 44 and 48. To that end, the base 32 may have a cross-over channel or flash groove in it that links together the propellant chambers 46 and 50.

The pressure in the propellant chamber 50 may be regulated by means of vents on the face of the vent plate 54, to prevent buildup of excessive pressure within the propellant chamber 50.

An initiator 60 is located at the aft end of the primary propellant chamber 46, to ignite or detonate the weight propellant charge 44. The initiator 60 may be an electrical igniter, such as a squib. The initiation of combustion or detonation of the weight propellant charge 44 in the primary propellant chamber 46 produces pressurized gases. The primary propellant chamber 46 is in communication with the angled holes 30 that have the weights 22 in them. The pressure buildup in the primary propellant chamber 46 thus quickly provides a large pressure force that ejects the weights 22 out of the angle holes 30. As noted above, this ejection is at an acute angle relative to the longitudinal axis 38. Combustion in the primary propellant chamber 46 thus serves to forcibly eject the weights 22 away from the base 32.

Combustion of the weight propellant charge 44 also initiates combustion of the net propellant charge 48 in the secondary propellant chamber 50. Combustion of the net propellant charge 48 produces pressurized gases which pass through openings in the vent plate 54. The pressurized gases that pass through the vent plate 54 press against a piston or wadding 68 that is in contact with the net 12. The wadding 68 may be a suitable fiberglass material that fills the inside of the tubular body 14, and allows effective use of the pressurized gases to expel the net 12 from the tubular body 14. The presence of the wadding 68 confines the pressurized gases passing through the vent plate 54 to a relatively small volume, and keeps pressurized gases from escaping behind the net 12. In addition the wadding protects the net 12 from the hot gasses from the combustion of the propellant.

The vent plate 54 caps off both of the propellant chambers 46 and 50. Screws or other suitable fasteners may be used to secure the vent plate 54 to the base 32.

The net 12 remains tethered to the rest of the inceptor projectile 10 even after the net 12 is deployed. The tether 16 runs from the center of the net 12 to an attachment point 72 in the center of the vent plate 54. The attachment 72 may be a short rod 74 that an end of the tether 16 loops around. The tether 16 may be made of a wire rope-polymer. This hybrid material tether 16 is able to absorb shock while providing high strength. The tether 16 passes through a central hole 76 in the wadding or piston 68.

The body 14 also houses a propulsion system or propulsion module 80 for propelling the interceptor projectile 10, as well as perhaps controlling the trajectory of the projectile 10. The propulsions system 80 may use conventional materials and methods, for example pressurized gasses that are expelled through a nozzle. Divert thrusters may be used to change the trajectory of the projectile 10.

The propulsion module 80 may itself provide pressurized gases that are used in deploying the net 12. The body 14 may have a suitable system of channels and chambers to allow pressurized gasses to from the propulsion module 80, to be used to deploy the net 12. Suitable valves or other flow control devices may be used to control the timing of deployment of the net 12.

Figure 4:
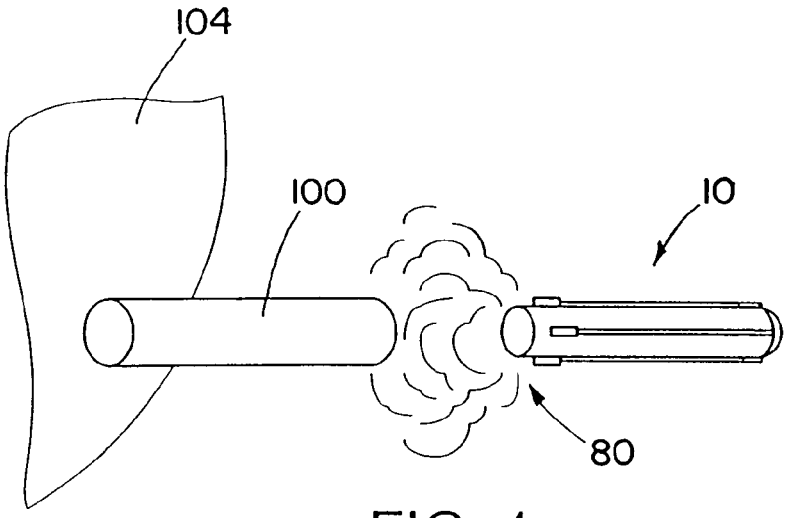
FIG. 4 illustrates a first step in use of the interceptor projectile of FIG. 1, according to an embodiment of the invention.

FIGS. 4-9 show steps in the deployment and use of the weapon interceptor projectile 10 to intercept an incoming projectile such as an RPG. FIG. 4 shows launch of the weapons projectile 10 from a launch tube 100 on a vehicle or structure 104. The vehicle or structure 104 may be any of a wide variety of movable or stationary objects. An example would be a helicopter or a ground vehicle such as a truck. The vehicle or structure 104 ordinarily would be the target of the incoming projectile. However, it will be appreciated that the vehicle or structure 104 that supports the launch tube 100 may be separate from the target for the incoming projectile.

The interceptor projectile 10 is fired from the launch tube 100 using any of a variety of well-known suitable methods for rapidly accelerating a projectile. An explosive charge that is placed in the launch tube 100 or that is part of the interceptor projectile 10 may be used to rapidly accelerate the interceptor projectile 10, firing the interceptor projectile 10 from the launch tube 100. It will be appreciated that non-chemical means may alternatively or in addition be used to fire the interceptor projectile 10. Examples of non-chemical acceleration mechanisms include use of magnetic forces and use of mechanical devices such as springs.

The propulsion module 80 of the interceptor projectile 10 may also be used to propel the interceptor projectile 10. Divert thrusters of the propulsion module 80 may be used to steer the interceptor projectile 10 in flight. The propulsion from the propulsion system 80 may cease prior to the deployment of the net 12 or the impact with the incoming projectile.

The interceptor projectile 10 may be fired from the launch tube 100 as soon as the firing of the incoming projectile is detected. Alternatively, firing of the interceptor projectile 10 may be delayed until the incoming projectile is a certain distance or time away from the launch tube 100 and/or the expected target of the incoming projectile. The firing of the interceptor projectile 10 may be made by a human operator or may be initiated automatically, such as by detection of the incoming projectile on radar or another tracking device.

Figure 5:
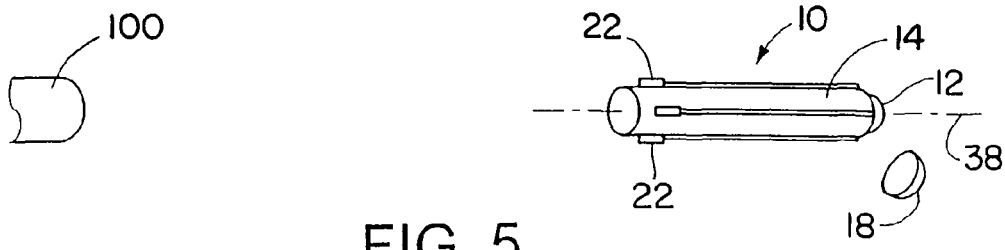
FIG. 5 illustrates a second step in the use of the interceptor projectile of FIG. 1.

FIG. 5 illustrates the initiation of the deployment of the net 12 and the weights 22. As described earlier deployment is started by firing of the initiator 60 to cause combustion or detonation of the propellant charges 44 and 48 (FIG. 2). This causes deployment of the net 12 out of the front end of the tubular body 14, pushing off the cap 18 of the interceptor projectile 10. The cap 18 is made of a suitable lightweight material, and is blown off by the pressure pushing the net 12 out. (As an alternative, the cap 18 could be hingedly coupled to the tubular body 14.) At the same time, the weights 22 are ejected from the angled holes 30 (FIG. 2) at acute angles to the interceptor projectiles longitudinal axis 38.

It may be advantageous for the interceptor projectile 10 to proceed a certain minimum distance from the launch tube 100 before initiating deployment of the weights 22 and the net 12. This may be accomplished by using a time-delay fuse or an electronic circuit to delay firing of the initiator 60. Alternatively the interceptor projectile 10 may be configured to initiate deployment at a desired distance away from the incoming projectile. Such initiation may be accomplished by varying the time delay on the initiator 60 when the interceptor projectile 10 is initially fired from the launch tube 100. Alternatively, the initiator 60 may be fired using an external signal, such as a signal from the vehicle or structure 104 or from a separate control center, operator, or other device.

Figure 6:
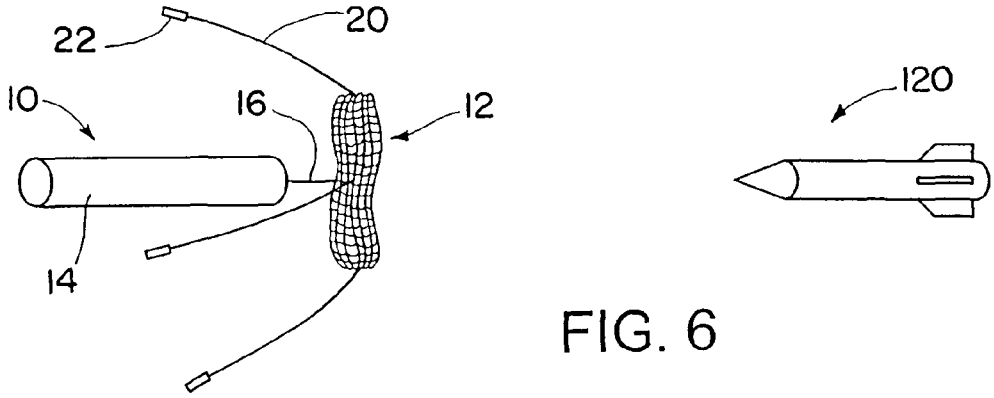
FIG. 6 illustrates a third step in the use of the interceptor projectile of FIG. 1.
Figure 7:
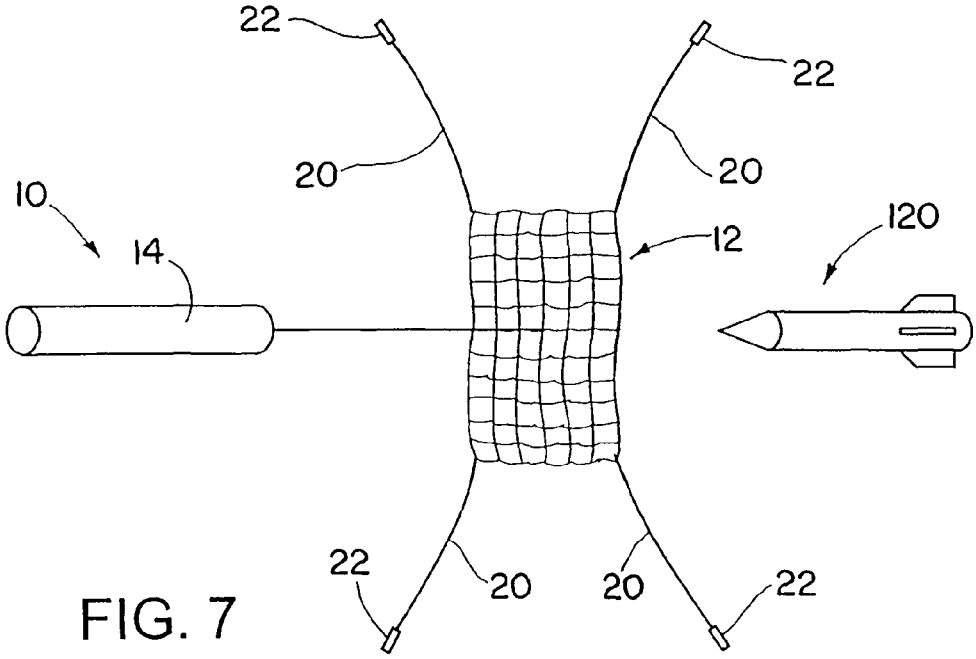
FIG. 7 illustrates a fourth step in the use of the interceptor projectile of FIG. 1.

FIGS. 5 and 6 show further deployment of the net 10 and the weights 22. The weights 22 may move faster than the center of the net 12, making the weights rotate to some extent relative to the center of the net 12 as the net 12 and the weights 22 both move toward the incoming projectile 120. The radially movement of weights 22 expand the net pulling it out to substantially its maximum deployed area, as shown in FIG. 7. It is advantageous to have the net 12 in a fully deployed condition, at substantially its maximum area, when the net 12 is approached by the incoming projectile 120.

As the net 12 and the weights 22 deploy, the net 12 remains attached to the tubular body 14 and the base 32, via the tether 16. The tether 16 is to some extent elastic, allowing stretching without breaking. The tether 16 may be made of nylon, hemp rope, metal, or another suitable material.

Figure 8:
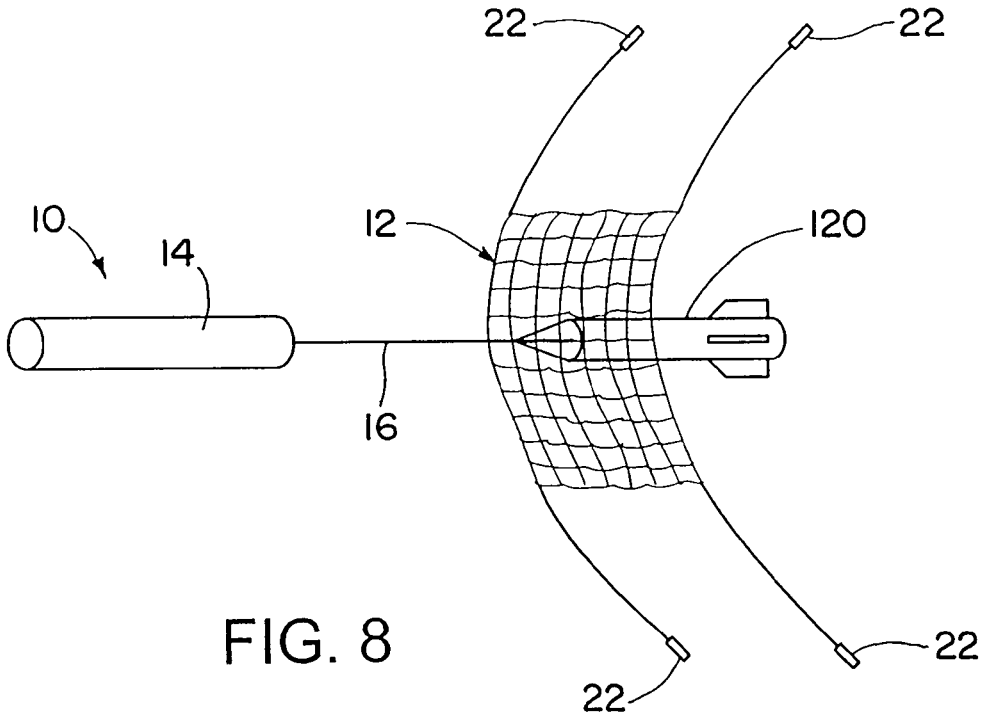
FIG. 8 illustrates a fifth step in the use of the interceptor projectile of FIG. 1.

FIG. 8 shows the initial contact between the incoming projectile 120 and net 12. The weights 22, which are not directly impacted by the incoming projectile 120, continue their forward movement past and around the incoming projectile 120. The weights 22 at the distal ends of the cables or lanyards 20 may act as "fingers" that close around the incoming projectile 120 in a manner analogous to the closing of the fingers of a hand around a small object held in the palm. The tether 16 may also aid in this "closing" process. Once the tether 16 pulls back after reaching its elastic limit, pulling back of the tether 16 aids in closing the net 12 around the incoming projectile 120.

The connection of the net 12 to the body 14 (using the tether 16) provides additional momentum over an impact using the net 12 alone. The momentum of the impacting parts of the interceptor projectile 10 may be at least that of the momentum of the incoming projectile 120. The impacting parts may have a momentum that is least 50% greater than the momentum of the incoming projectile 120.

The impact of the interceptor projectile 10 with the incoming projectile 120 transfers momentum from the interceptor projectile 10 to the incoming projectile 120. Momentum may be transferred from both the net 12 and the body 14 to the incoming projectile 120. The transfer of the momentum from the interceptor projectile 10 to the incoming projectile 120 changes the direction of flight and/or the speed of the incoming projectile 120. It will be appreciated that the greater the momentum transfer to the incoming projectile 120, the greater the change in velocity and direction of the incoming projectile 120.

The impacting parts of the interceptor projectile 10 may include substantially all of the launched interceptor projectile 10. Possible exceptions include the cap 18 and the material for forming the pressurized gases. "The interceptor projectile 10" may be used herein as a shorthand reference to "the impacting parts of the interceptor projectile 10."

Figure 9:
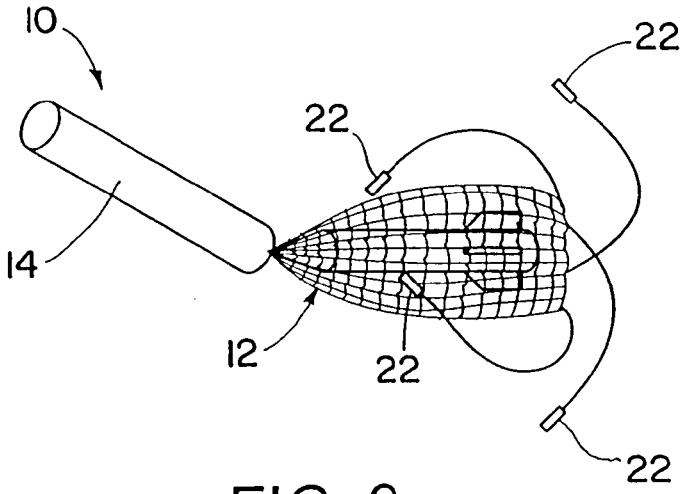
FIG. 9 illustrates a sixth step in the use of the interceptor projectile of FIG. 1.

FIG. 9 shows the conclusion of the process with the projectile 120 fully encased by the net 12. The weights 22 may be wrapped around the net 12 and the projectile 10 along any of a variety of paths or directions. This aids in securing the net 12 to the incoming projectile 120. Various parts of the interceptor projectile 10 contact and push the incoming projectile 120 in any of a variety of directions, sending the incoming projectile 120 off course and keeping the incoming projectile 120 from reaching its intended target.

The deployment process illustrated in FIGS. 4-9 may occur on the order of milliseconds of time.

In deployment the weights 22 move radially outward, and then move back radially inward as they rotate about the center of the net 12. This inward rotation may be initiated by or accelerated by a collision between the incoming projectile 120 and the net 12.

One advantage of the interceptor projectile 10 is that substantially all of the projectile 10 remains mechanically coupled together even after deployment of the net 12 and the weights 22. This reduces or eliminates the number of stray parts or pieces that fly off at a high speed and may cause undesirable injuries or damage.

The wrapping of the net 12 securely around the incoming projectile 120 may also minimize the chances for undesirable collateral damage. In the event that the incoming projectile 120 fragments into pieces, either due to impact forces or due to fuel or an explosive on the incoming projectile 120 detonating, the net 12 may serve to secure together the resulting pieces or fragments of the incoming projectile 120. Even if the fragments are not completely secured, their destructiveness may be reduced by wrapping the incoming projectile 120 in the net 12. Again, by reducing or eliminating the number of additional pieces of high-speed material generated, undesired personnel injuries or physical damage advantageously may be reduced. Also, the interceptor projectile 10 disables the incoming projectile 120 without the use of explosives to destroy or disable the incoming projectile 120. By not using explosives there is no pressure wave created that might cause undesirable damage.

The deployment of the net 12 advantageously provides a large area which may snare the incoming projectile 120 even if the interceptor projectile 10 is not aimed precisely at the incoming projectile 120.

The interceptor projectile 10 may have any of a variety of sizes and configurations, and may be used for intercepting and disabling any of a variety of projectiles. An example of an alternative to an RPG is use of an interceptor projectile such as that described above to intercept and disable an unmanned air vehicle (UAV). One advantage of the interceptor projectile 10 is that it may be possible to disable the incoming projectile 120 without destroying the incoming projectile 120. It will be appreciated that in some instances it is desirable to capture and study an incoming projectile such as a UAV.

In addition it will be appreciated that the interceptor projectile 10 shown in the figures and described above is only one of a large variety of possible variety of possible configurations with a net attached to a body even when deployed, such as by a tether. Various configurations of deployment systems and deployed nets may be utilized in carrying out the concept of an interceptor projectile that includes increasing momentum of impact by keeping parts of, most of, or substantially all of the interceptor projectile mechanically coupled to the deployed net. Some or all of the above-described features may be combined with additional or alternative features of an alternate embodiment interceptor projectile.

Figure 10:
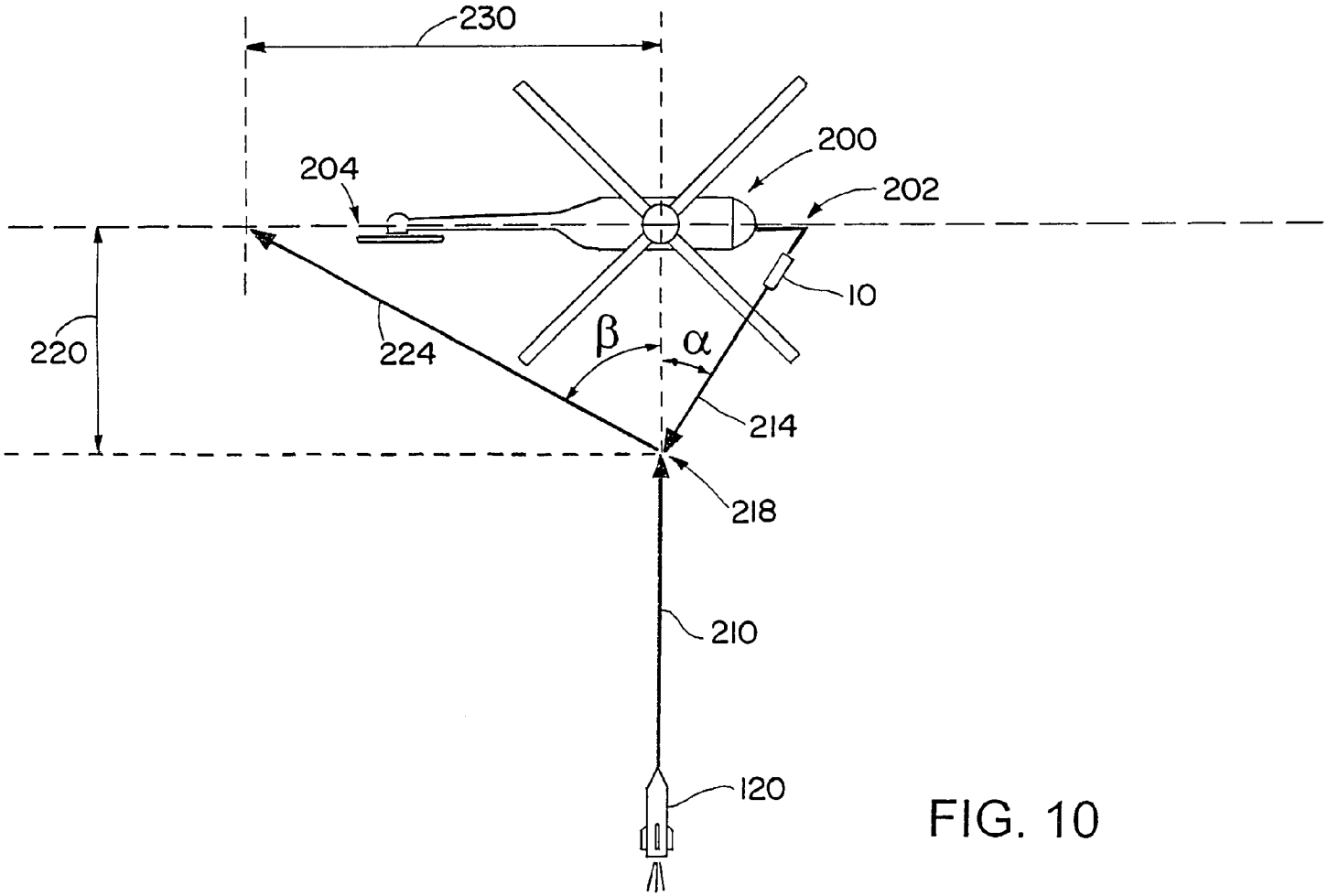
FIG. 10 is a plan view illustrating a system according to an embodiment of the present invention, in which interceptor projectiles may be fired from any of multiple locations.

FIG. 10 shows a vehicle 200 having a pair of launch or firing locations 202 and 204 from which interceptor projectiles 10 may be fired. The firing locations may be at opposite ends of the vehicle, for example being located the front and back of the vehicle 200, such as on suitable booms. The timing and direction of the firing of interceptor projectiles 10 may be selected so as to impact the incoming projectile 120 that is approaching the vehicle 200 at a trajectory 210. The interceptor projectile 10 is directed at an interception trajectory 214, to impact the incoming projectile 120 at an impact point 218. The trajectory 214 may be accomplished by divert thrusters that are part of the propulsion system or propulsion module of the interceptor projectile 10. The impact point 218 is at an interceptor range 220 away from the target or vehicle 200. The impact imparts momentum from the interceptor projectile 10 to the incoming projectile 120, diverting the incoming projectile 120 off on a modified trajectory, a divert trajectory 224. The interception trajectory 214 is at an angle $\alpha$ relative to the incoming projectile trajectory 210. The divert trajectory 224 is an angle $\beta$ relative the trajectory 210. The divert angle $\beta$ may be greater than the interception angle $\alpha$. The timing and trajectory of the firing of the interceptor 10 may be selected so as to locate the impact point 218 such that the incoming projectile 120 is diverted a divert distance 230 away from its intended impact with the vehicle 200. This divert distance 230 is sufficiently large for the incoming projectile 120 to miss the target or vehicle 200.

A selection of which of the firing locations 202 and 204 from which an interceptor projectile 10 is to be fired may be made so as to most easily divert the incoming projectile 120 away from the vehicle 200. By having two or more firing locations that are apart from one another, it may be possible to achieve one or more of a larger divert distance, a closer intercept range (allowing later firing of the interceptor projectile), a better chance of interception, and/or a larger margin of error, than may be achievable with a single firing or launching location. The selection of which of the locations 202 and 204 to fire an interceptor projectile from may be made based on one or more of: the incoming projectile trajectory 210; the speed of the incoming projectile 120; the range of the incoming projectile 120 to the vehicle 200; the velocity (speed and trajectory) of the vehicle 200; and the number of interceptor projectiles 10 available at each of the locations 202 and 204.

Figure 11:
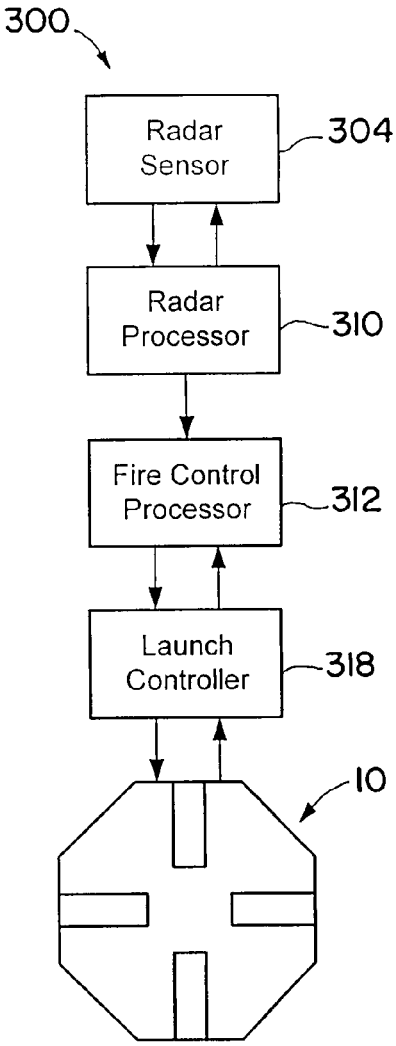
FIG. 11 is a block diagram of the system of FIG. 10.
Figure 12:
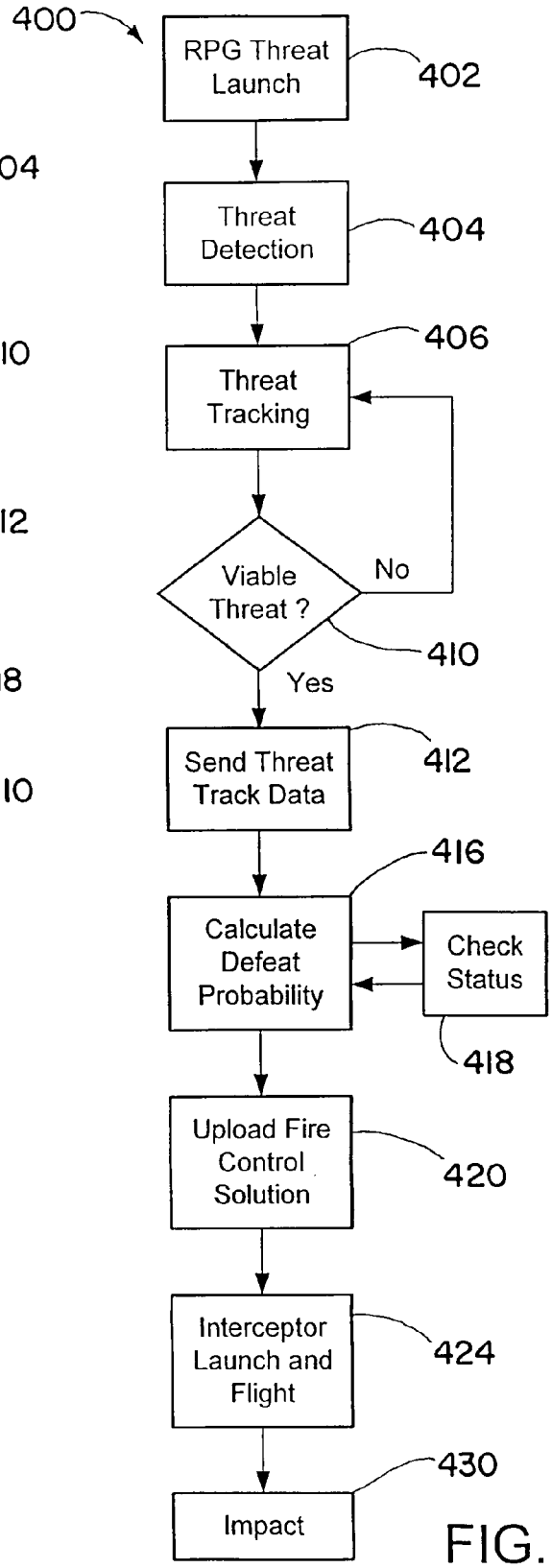
FIG. 12 is a high-level flow chart of a method utilizing of the systems of FIGS. 10 and 11.

With reference now in addition to FIGS. 11 and 12, a system 300 and a method 400 are shown for carrying out the firing from multiple locations, such as from the vehicle 200 (FIG. 10). In step 402 the RPG or other projectile is launched. In step 404 a radar sensor 304 detects the incoming RPG or other projectile. Tacking and acquisition of the threatening RPG or other projectile is continued in step 406.

A radar processor 310 makes a determination in step 410 whether threat poses a viable hazard of impacting the vehicle or other target. If the threat is not viable the process returns to the continued tracking in step 406. If the threat is viable, threat track data is sent to a fire control processor 312 in step 412. Such data may include the range, speed, and trajectory of the incoming projectile threat, as well as other possible data.

In step 416 the fire control processor 312 calculates a highest defeat probability based on the threat track data, and possibly other factors, for example interceptor status (e.g., number, location, and readiness of interceptors). In performing and in preparation for step 416, the fire control processor 312 may receive information from a launch controller 318, as indicated in block/step 418.

In step 420 the fire control processor 312 activates the launch controller 318, which uploads a fire control solution to an interceptor projectile 10 at an appropriate location. The launch controller 318 then commands launch of the interceptor projectile 10. The interceptor projectile 10 carries out its mission in step 424, firing its motors for propulsion to an intercept location, and using a fuze or timer to deploy its net. The interceptor projectile 10 impacts the incoming RPG or other threat in step 430.

It will be appreciated that the three or more firing locations may be used, to provide a greater choice for firing locations. A helicopter is shown as the vehicle 200, but it will be appreciated that a wide variety of types of land, sea, and air vehicles may serve as a platform for selectively firing interceptor projectiles from multiple possible locations. The target need not even be a vehicle, but instead may be stationary. In addition the platform that supports the firing locations need not itself be the target of the incoming projectile 120 (FIG. 10).

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A weapon interceptor projectile comprising: a body, wherein the body includes a propulsion module that propels the projectile; a net; and a tether attaching the net to the body, even after deployment of the net; wherein the propulsion module is aft of the net.

2. The projectile of claim 1, wherein the tether is an elastic tether.

3. The projectile of claim 2, wherein the elastic tether is a nylon tether.

4. The projectile of claim 1, wherein the net is located at least partially in the body, prior to the deployment of the net.

5. The projectile of claim 1, wherein the propulsion module also provides pressurized gas that deploys the net.

6. A method of defending against an incoming projectile, the method comprising:

directing an interceptor projectile toward the incoming projectile;

deploying a net from the interceptor projectile, while maintaining attachment between the net and an interceptor body of the interceptor projectile, using a tether; and impacting the incoming projectile with the interceptor projectile, thereby deflecting the incoming projectile.

7. The method of claim 6, wherein the impacting includes transferring momentum from both the interceptor body and the net to the incoming projectile.

8. The method of claim 6, wherein the impacting includes the interceptor projectile having at least as much momentum as the incoming projectile at the start of the impacting.

9. The method of claim 6, wherein the impacting includes the interceptor projectile having at least 50% more momentum than the incoming projectile at the start of the impacting.

10. The method of claim 6, further comprising, prior to the directing, selecting a firing location, from among multiple interceptor projectile firing locations, from which the directing occurs.

11. The method of claim 10, wherein the selecting includes selecting as a function of at least a trajectory of the incoming projectile.

12. The method of claim 11, wherein the selecting also includes selecting as a function of at least a velocity of the interceptor projectile firing locations.

13. The method of claim 10, wherein the multiple interceptor projectile firing locations are located on a vehicle.

14. The method of claim 13, wherein the selecting also includes selecting firing angle at which the interceptor projectile is initially directed.

15. The method of claim 14, wherein the selecting the firing angle includes selecting the firing angle such that the projectile does not impact the vehicle.

16. The method of claim 6, wherein the impacting includes wrapping at least part of the net around at least part of the incoming projectile, thereby mechanically connecting together the interceptor projectile and the incoming projectile.

17. The method of claim 6 wherein the directing includes propelling the interceptor projectile with a propulsion module of the interceptor.

18. The method of claim 17, wherein the deploying includes deploying the net using pressurized gas from the propulsion module.

19. The method of claim 17 wherein the impacting includes impacting after the propelling has ceased.

* * * * *